US011137223B2

(12) United States Patent
Christiansen et al.

(10) Patent No.: US 11,137,223 B2
(45) Date of Patent: Oct. 5, 2021

(54) NON-SEMIAUTOMATIC WEAPON AND SEMIAUTOMATIC TO NON-SEMIAUTOMATIC CONVERSION DEVICE

(71) Applicants: Richard Bert Christiansen, San Diego, CA (US); Cort Wetherald, San Diego, CA (US)

(72) Inventors: Richard Bert Christiansen, San Diego, CA (US); Cort Wetherald, San Diego, CA (US)

( * ) Notice: Subject to any disclaimer, the term of this patent is extended or adjusted under 35 U.S.C. 154(b) by 105 days.

(21) Appl. No.: 15/890,346

(22) Filed: Feb. 6, 2018

(65) Prior Publication Data

US 2019/0128627 A1 May 2, 2019

Related U.S. Application Data

(60) Provisional application No. 62/455,575, filed on Feb. 6, 2017.

(51) Int. Cl.

| | |
|---|---|
| ***F41A 9/38*** | (2006.01) |
| ***F41A 3/70*** | (2006.01) |
| ***F41A 3/80*** | (2006.01) |
| ***F41A 3/68*** | (2006.01) |
| ***F41A 9/41*** | (2006.01) |
| ***F41A 3/72*** | (2006.01) |
| ***F41A 17/36*** | (2006.01) |
| *F41A 3/12* | (2006.01) |
| *F41A 19/46* | (2006.01) |
| *F41A 19/33* | (2006.01) |

(52) U.S. Cl.
CPC *F41A 9/38* (2013.01); *F41A 3/68* (2013.01); *F41A 3/70* (2013.01); *F41A 3/72* (2013.01); *F41A 3/80* (2013.01); *F41A 9/41* (2013.01); *F41A 17/36* (2013.01); *F41A 3/12* (2013.01); *F41A 19/33* (2013.01); *F41A 19/46* (2013.01)

(58) Field of Classification Search
CPC ..... F41A 9/38; F41A 9/41; F41A 3/68; F41A 3/70; F41A 3/72; F41A 3/80; F41A 3/12; F41A 17/36; F41A 19/33; F41A 19/46
USPC ..... 42/2
See application file for complete search history.

(56) References Cited

U.S. PATENT DOCUMENTS

| | | | | |
|---|---|---|---|---|
| 6,901,837 | B2 * | 6/2005 | Johnson | F41A 3/12 42/90 |
| 9,482,480 | B2 * | 11/2016 | O'Dell | F41A 17/36 |
| 2003/0208941 | A1 * | 11/2003 | Johnson | F41A 3/72 42/18 |
| 2016/0348991 | A1 * | 12/2016 | Tisone | F41A 9/59 |
| 2018/0100714 | A1 * | 4/2018 | Borders | F41A 17/42 |

* cited by examiner

*Primary Examiner* — Samir Abdosh

(57) ABSTRACT

A bolt catch device is disclosed. The bolt catch includes a movable surface configured to be positioned within a weapon so as to conditionally engage a bolt so as to prevent the bolt from rechambering a next round from a magazine, a tip configured to, in response to a received force, cause the movable surface to move so as to release the bolt, and a spring engagement feature configured to be positioned within the weapon so as to receive a spring within the weapon, wherein the spring within the weapon is configured to bias the movable surface toward a position which prevents the bolt from rechambering a next round.

15 Claims, 15 Drawing Sheets

FIG. 10
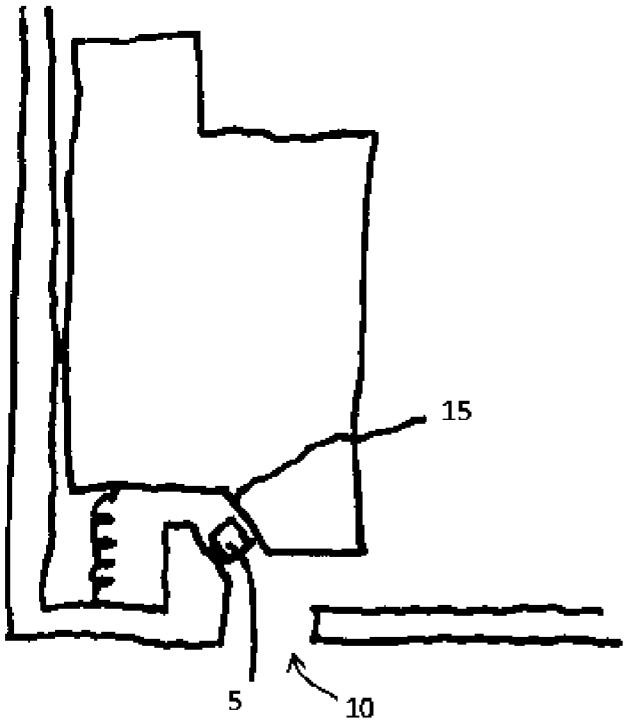
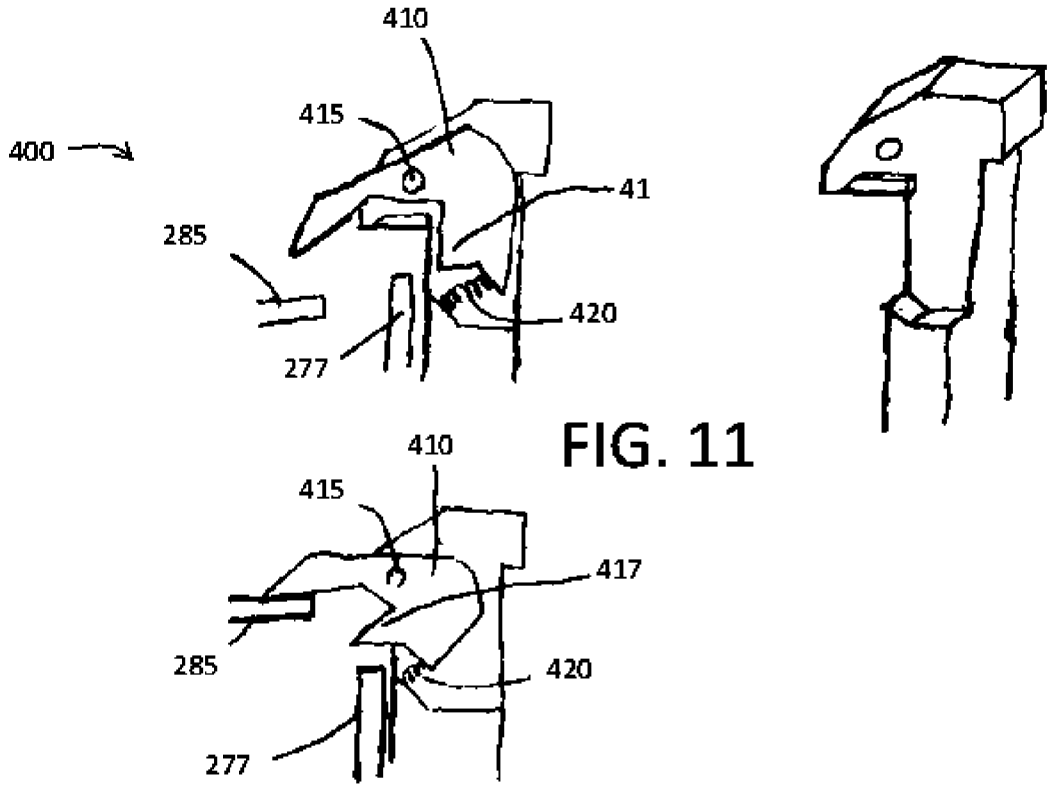
FIG. 11

NON-SEMIAUTOMATIC WEAPON AND SEMIAUTOMATIC TO NON-SEMIAUTOMATIC CONVERSION DEVICE

CROSS-REFERENCE TO RELATED APPLICATION

The present application claims the benefit of U.S. Provisional Application No. 62/455,575, filed Feb. 6, 2017, the entire contents of which are hereby incorporated by reference for all purposes.

FIELD OF THE INVENTION

The present application generally non-semiautomatic weapons, and more particularly to a conversion devices configured to convert the action of weapons to and from single action.

BACKGROUND OF THE INVENTION

It may be beneficial to convert the action of a weapon from another action to single shot. Likewise, it may be beneficial to convert the action of a weapon from single shot to another action. Devices are needed to facilitate such conversions.

BRIEF SUMMARY OF THE INVENTION

One inventive aspect is a bolt catch device. The bolt catch includes a movable surface configured to be positioned within a weapon so as to conditionally engage a bolt so as to prevent the bolt from rechambering a next round from a magazine, a tip configured to, in response to a received force, cause the movable surface to move so as to release the bolt, and a spring engagement feature configured to be positioned within the weapon so as to receive a spring within the weapon, wherein the spring within the weapon is configured to bias the movable surface toward a position which prevents the bolt from rechambering a next round.

Another inventive aspect is a weapon, comprising: an upper receiver, a bolt carrier group connected to the upper receiver, and a lower receiver, comprising a cavity configured to receive a bolt catch. The weapon also includes a spring at least partially within the cavity, and a bolt catch device attached to the lower receiver and positioned so as to be partially within the cavity. The bolt catch device includes a movable surface configured to conditionally engage the bolt carrier group so as to prevent the bolt carrier group from rechambering a next round from the magazine, a tip configured to, in response to a received force, cause the movable surface to move so as to allow the bolt carrier group to rechamber the next round, and a spring engagement feature configured to engage the spring, where the spring is configured to bias the movable surface toward a position which prevents the bolt carrier group from rechambering a next round.

Another inventive aspect includes a method of assembling a weapon. The method includes providing an upper receiver having a bolt carrier group, providing a lower receiver comprising a cavity configured to receive a bolt catch device, and placing a spring at least partially within the cavity. The method also includes attaching a bolt catch device to the lower receiver such that the bolt catch device is partially within the cavity and is configured to engage the bolt carrier group.

BRIEF DESCRIPTION OF THE DRAWINGS

FIG. 6 illustrates a lower receiver 277 and exemplary positions the tip 250 of bolt catch control device 200 may extend to.

FIG. 10 illustrates an embodiment configured to prevent the bolt catch from releasing the captive bolt as a result of the last round of a magazine being fired.

FIG. 11 illustrates various views of an alternative embodiment 400 configured to prevent the bolt catch from releasing the captive bolt as a result of the last round of a magazine being fired.

DETAILED DESCRIPTION OF THE INVENTION

Particular embodiments of the invention are illustrated herein in conjunction with the drawings.

Various details are set forth herein as they relate to certain embodiments. However, the invention can also be implemented in ways which are different from those described herein. Modifications can be made to the discussed embodiments by those skilled in the art without departing from the invention. Therefore, the invention is not limited to particular embodiments disclosed herein. For example, features in each of the disclosed embodiments may be combined with features of one or more other disclosed embodiments in implementations not explicitly described.

Figure 1:
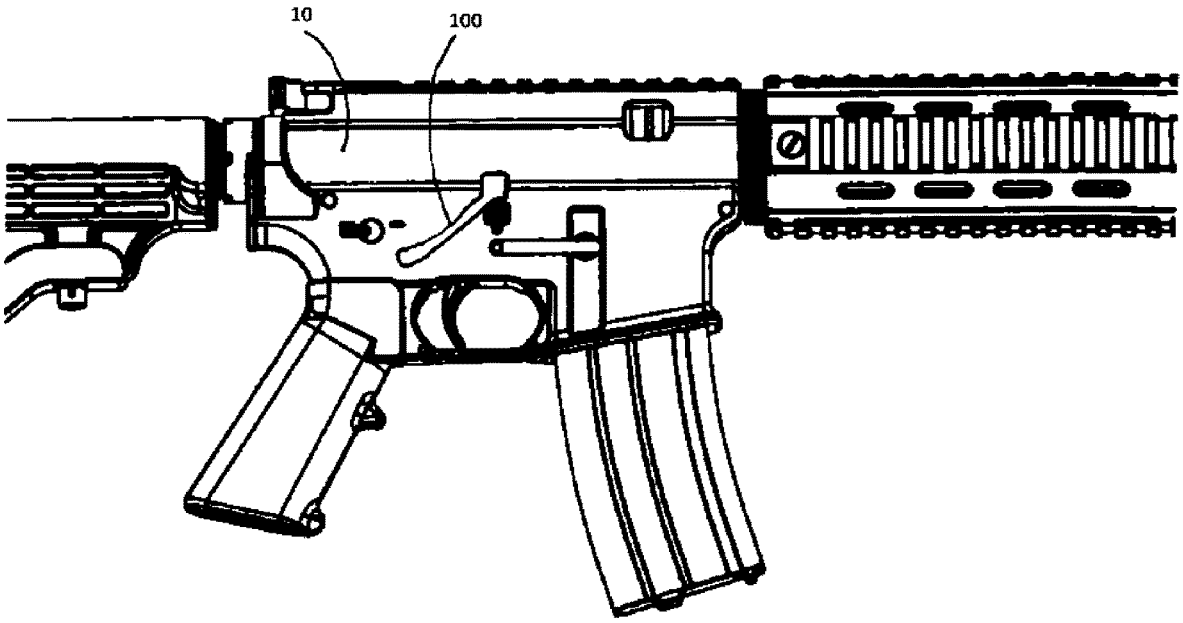
FIG. 1 is an illustration of a weapon 10 having detachable bolt catch control device 100.

FIG. 1 is an illustration of a weapon 10 having detachable bolt catch control device 100. With bolt catch control 100 attached weapon 10 is a single shot, non-semiautomatic firearm. In such an embodiment, a pull of the trigger causes, when a bullet is chambered and the weapon 10 is cocked, a single round to be fired. However, a next round is not chambered by the pulling of the trigger and the firing of the single round. Rather, in order to chamber a next round the bolt catch control 100 must be actuated. Weapon 10 additionally has features which are similar or identical to other semiautomatic firearms such as, for example, AR-15, AR-10, or other weapons.

Figure 2A:
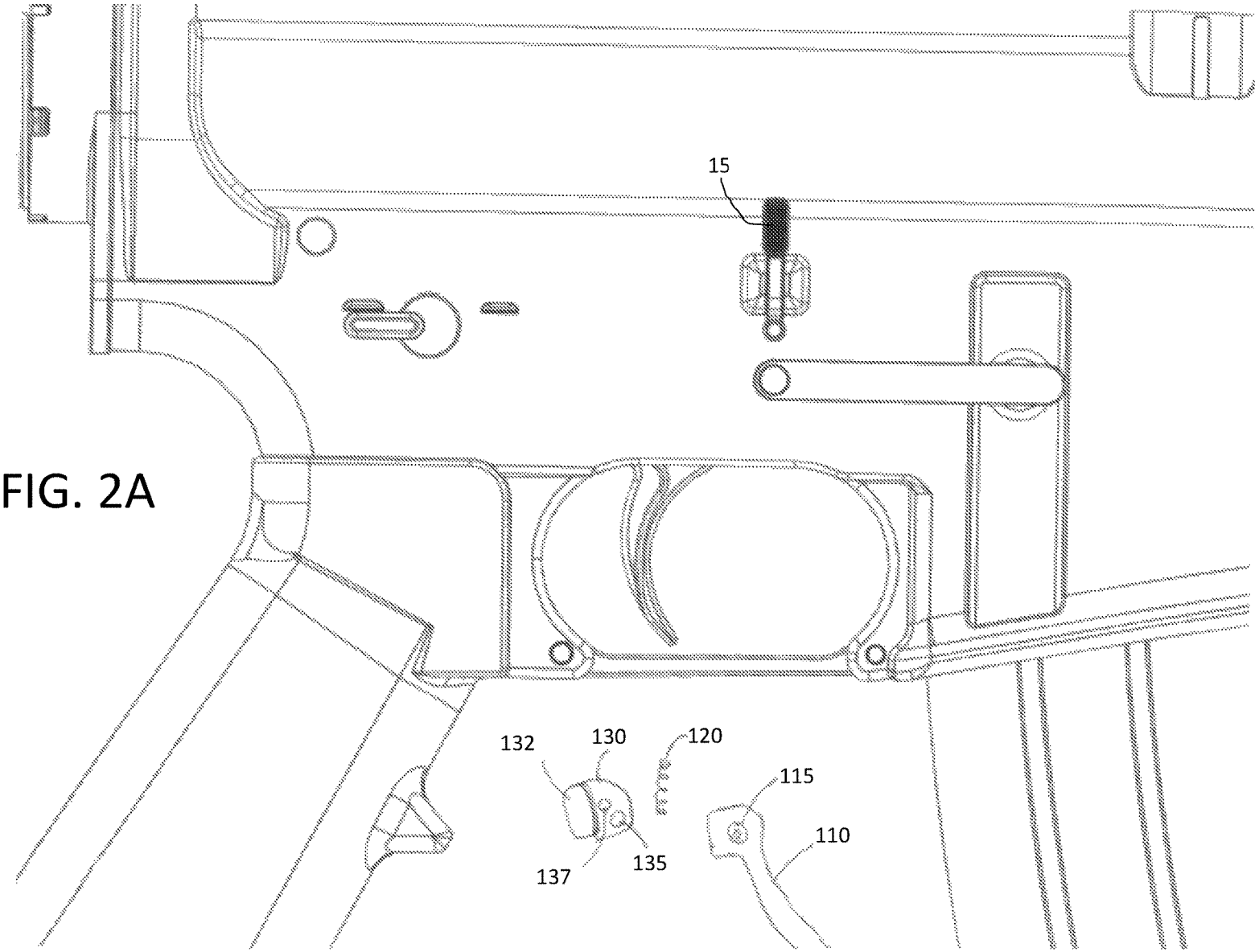
FIGS. 2A and 2B are illustrations of weapon 10 having bolt catch control device 100 detached.
Figure 2B:
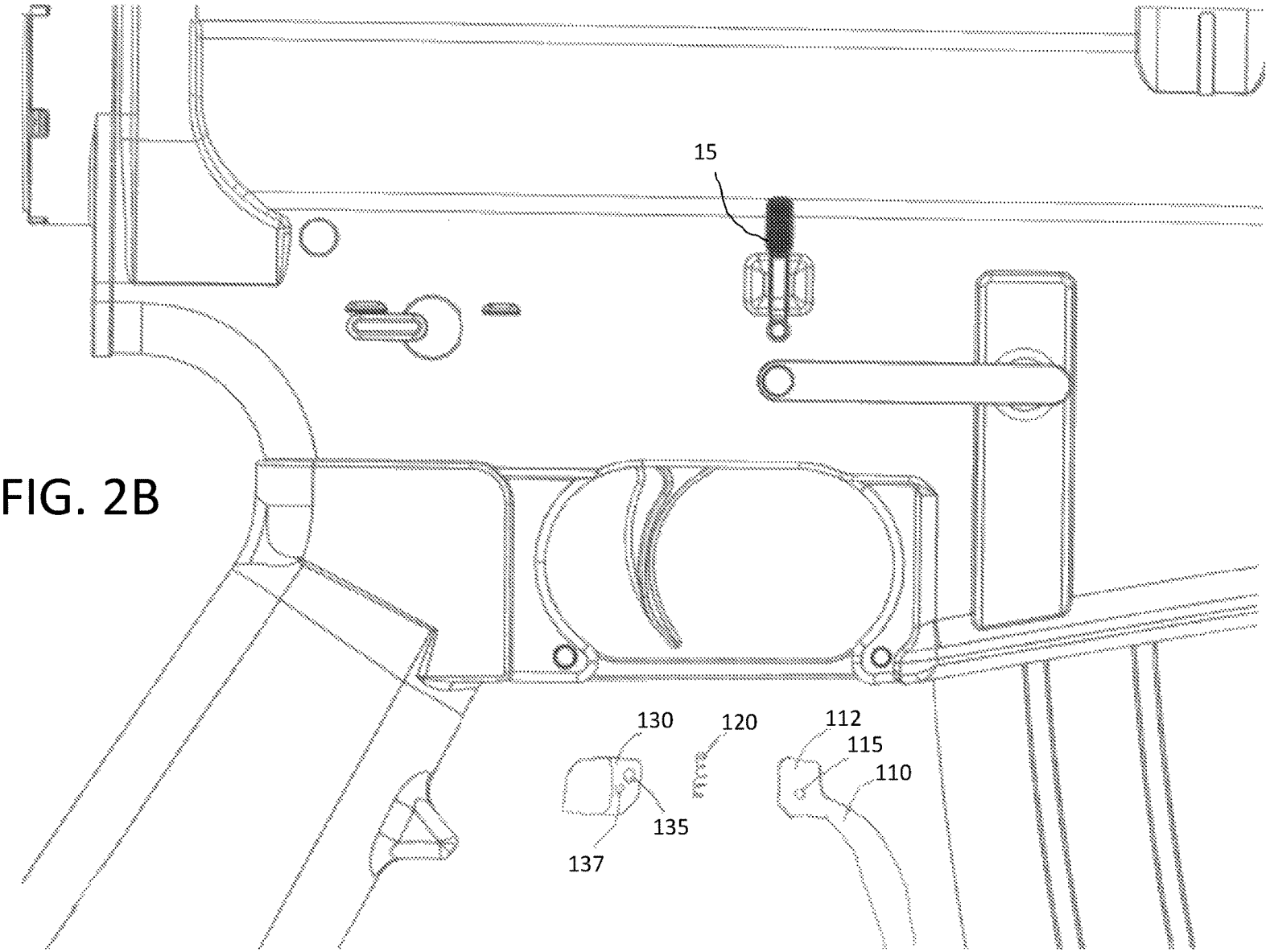

FIGS. 2A and 2B are illustrations of weapon 10 having bolt catch control device 100 detached. As shown, bolt catch 15 is exposed. As known, bolt catch 15 conditionally prevents the bolt carrier group (not shown) of weapon 10 from chambering a next round in response to the firing of a previous round if the fired previous round was the last round in the magazine. Without bolt catch control device 100, bolt catch 15 does not prevent the bolt carrier group of weapon 10 from chambering a next round in response to the firing of a previous round if the fired previous round was not the last round in the magazine.

FIGS. 2A and 2B also illustrate bolt catch control device 100 in a disassembled state. As shown, bolt catch control device 100 includes front 110, back 130, spring 120, and screw 115.

When assembled, screw 115 extends through front 110 into threaded hole 137 of back 130. In addition, when assembled, spring 120 extends through hole 135 of back 130 and engages front 110.

As shown, front 110 has contour feature 112 which is configured to engage the illustrated side of bolt catch 15 when bolt catch control device 100 is assembled and attached to bolt catch 15. In addition, back 130 has contour feature 132 which is configured to engage the side (not shown) of bolt catch 15 opposite that illustrated when bolt catch control device 100 is assembled and attached to bolt catch 15.

Figure 3:
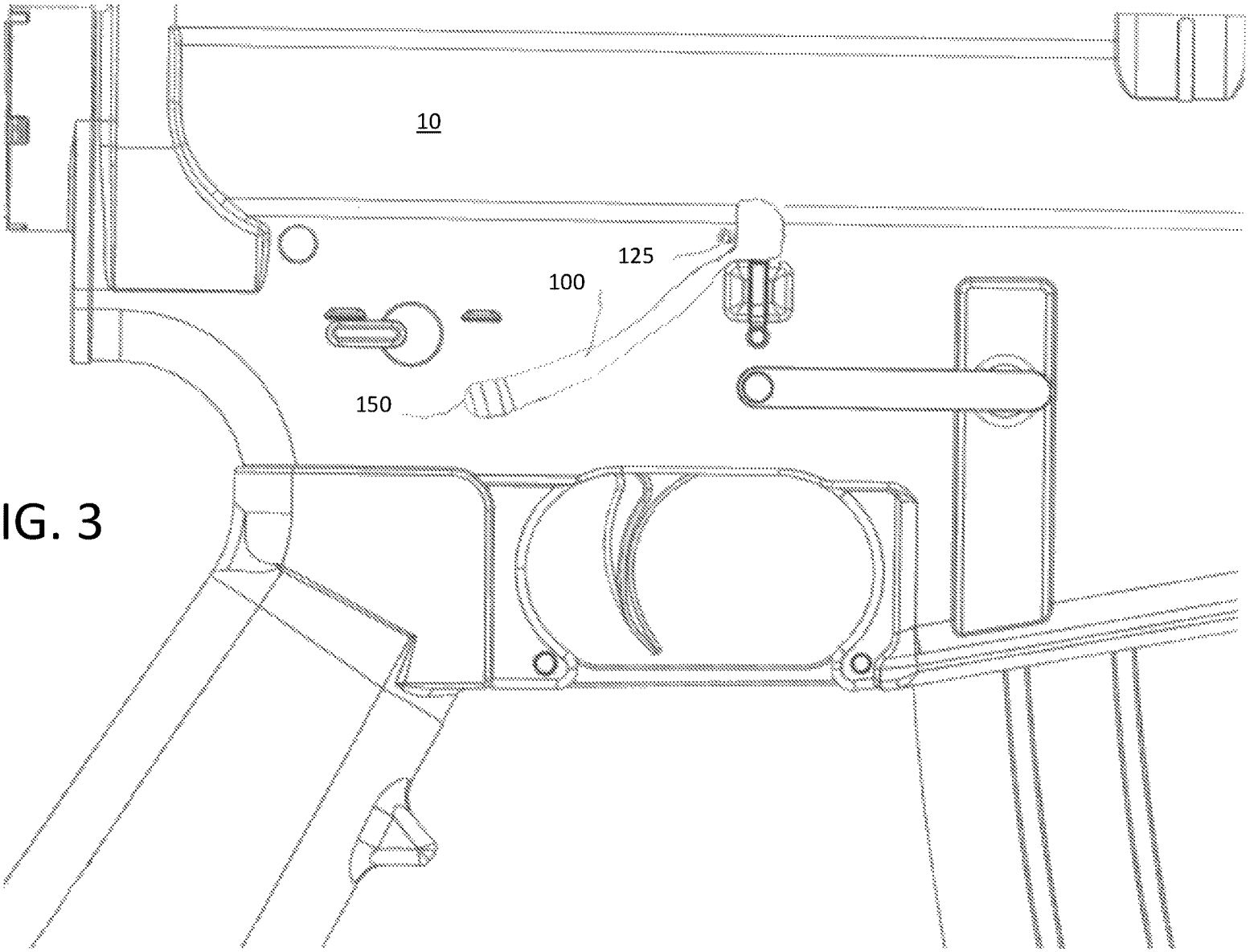
FIG. 3 illustrates weapon 10 having bolt catch control device 100 assembled and attached thereto.

FIG. 3 illustrates weapon 10 having bolt catch control device 100 assembled and attached thereto. As shown, spring 120 causes bolt catch 15 to be in a position preventing the bolt carrier group of weapon 10 from chambering a next round in response to the firing of a previous round regardless of whether the previous round was the last round of the magazine. For example, spring 120 causes bolt catch 15 to be in a position preventing the bolt carrier group of weapon 10 from chambering a next round in response to the firing of a previous round even if the magazine has one or more additional rounds therein.

To cause the next round from the magazine to be chambered, the bolt catch control device 100 is actuated by applying an actuation force to an actuation surface of the bolt catch control device 100. The applied actuation force causes the spring 120 to compress and causes the bolt catch 15 to rotate and to release the bolt carrier group of the weapon 10. As a result, the next round from the magazine is chambered.

In the illustrated embodiment, the bolt catch control device 100 is actuatable by applying the actuation force to the tip 150 causing rotation of the bolt catch control device 100. In some embodiments, the bolt catch control device 100 is actuatable by applying the actuation force to an actuation surface of the bolt catch control device 100 facing weapon 10, causing rotation of the bolt catch control device 100. An actuation force may be applied to an actuation surface, for example, by a finger of a shooting hand of a shooter of weapon 10. For example, the shooter may apply a rotational force to tip 150 or another actuation surface with a thumb of the shooting hand.

In some embodiments, the tip 150 or other actuation surface may be positioned so as to be adjacent another finger of the shooting hand, such that a rotational actuation force actuating the bolt catch control device 100 may be conveniently applied by the adjacent finger.

In some embodiments, the tip 150 or other actuation surface is positioned on the side of the weapon opposite that illustrated, for example, so as to be adjacent a finger of the shooting hand when the shooter is using a left hand to shoot.

In some embodiments, the tip 150 or other actuation surface is adjustably connected to the remainder of the bolt catch control device 100, such that its position may be customized for a user.

To operate a weapon having a bolt catch control device, a first round is fired in response to a first trigger pull. Because of the force exerted by the spring of the bolt catch control device against the weapon, the bolt catch of the weapon is rotated to a position so that the bolt catch prevents the bolt carrier group of the weapon from chambering a next round from the magazine in response to the previous round being fired. To chamber the next round, the bolt catch control device is actuated. Actuation of the bolt catch control device causes the bolt catch to release the bolt carrier group, which, in response to being released, causes the next round to be chambered. Once chambered, the next round is ready to be fired with a next trigger pull.

In some embodiments, the spring of the bolt catch control device is internal to the weapon and engages the bolt catch and another portion of the weapon so as to exert a force on the bolt catch causing the bolt catch to rotate to a position so that the bolt catch prevents the bolt carrier group of the weapon from chambering a next round from the magazine in response to a previous round being fired. In such embodiments, the bolt catch control device otherwise operates similar or identical to the operation of other embodiments described herein.

In some embodiments the conventional spring of the bolt catch is removed. The conventional spring, with no bolt catch control device attached to the weapon, rotates the bolt catch to a position which allows the bolt carrier group of the weapon to chamber a next round from the magazine in response to a previous round being fired.

FIGS. 4A-4D and 5A-5F illustrate embodiments of bolt catch control devices 200 having a tip on 250 connected by a lever-arm or arm 240 extending from a back 230 to a tip 250. The back 230 may be connected to a front 210, for example, by a screw (not shown).

Various springs and various spring configurations may be used.

Figure 4A:
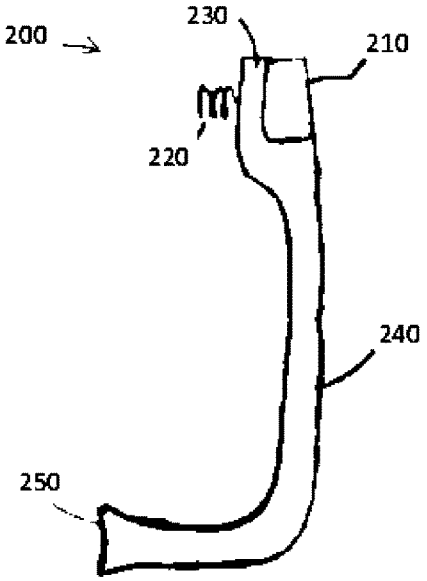
FIGS. 4A-4D and 5A-5F illustrate embodiments of bolt catch control devices 200 having a tip on 250 connected by a lever-arm or arm 240 extending from a back 230 to a tip 250.

FIG. 4A illustrates a compression spring 220 connected to back 230.

Figure 4B:
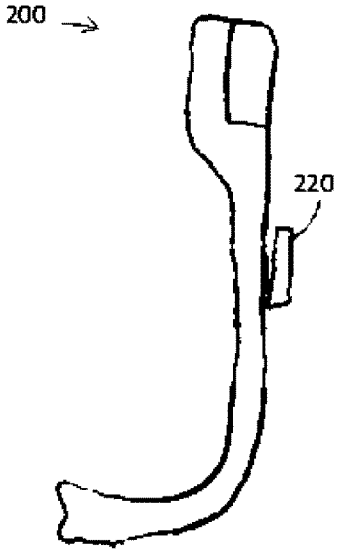

FIG. 4B illustrates a leaf spring or flat spring 220 configured to exert a force on the bolt catch control device of FIG. 4B. Spring 220 of FIG. 4B may be fixed to the weapon. For example, spring 220 of FIG. 4B may be fixed to a magazine release or another feature of the weapon.

Figure 4C:
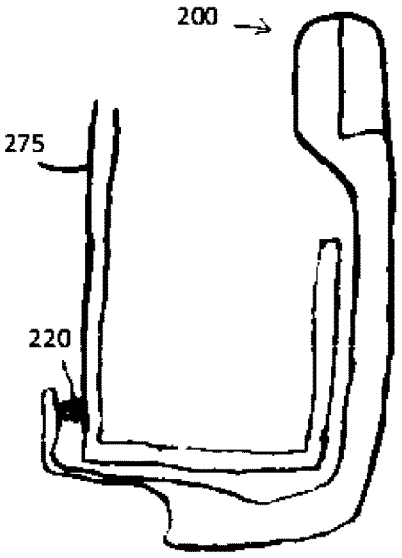

FIG. 4C illustrates a bolt catch control device which extends through a trigger guard. A portion of the bolt catch control device of FIG. 4C engages compression spring 220, which presses against the weapon 275 and the bolt catch control device.

Figure 4D:
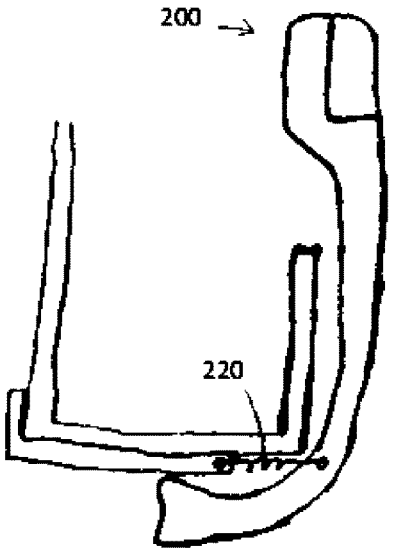

FIG. 4D illustrates a bolt catch control device having 2 pieces connected by a tension spring 220.

Figure 5A:
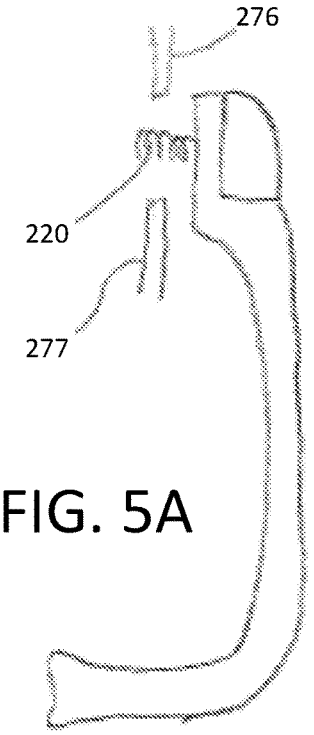

FIG. 5A illustrates circumstances in which spring 220 may be damaged. During the process of attaching an upper receiver 276 to a lower receiver 277, a portion of upper receiver 276 may pinch spring 220 against lower receiver 277. The pinching may damage spring 220 and/or may cause the bolt catch control device to not function properly.

FIGS. 5B-5F illustrates embodiments of bolt catch control devices which are not susceptible to such pinching.

Figure 5B:
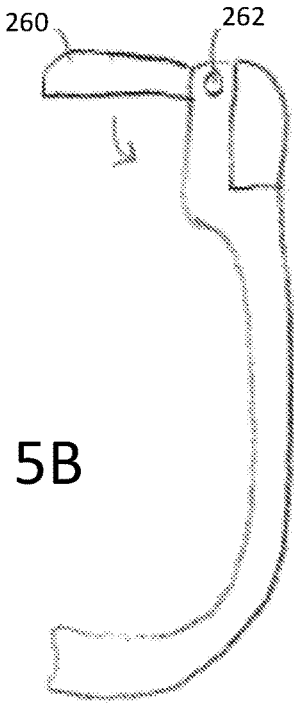
Figure 5C:
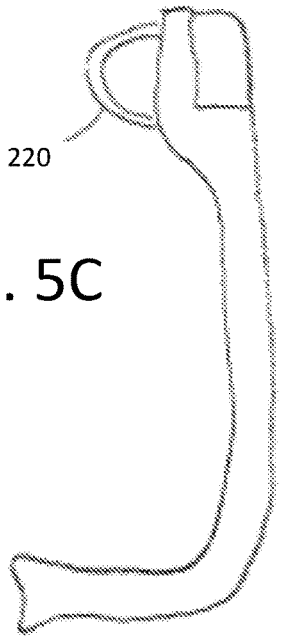
Figure 5D:
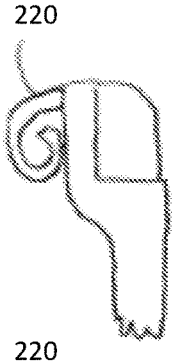
Figure 5E:
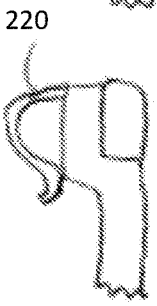
Figure 5F:
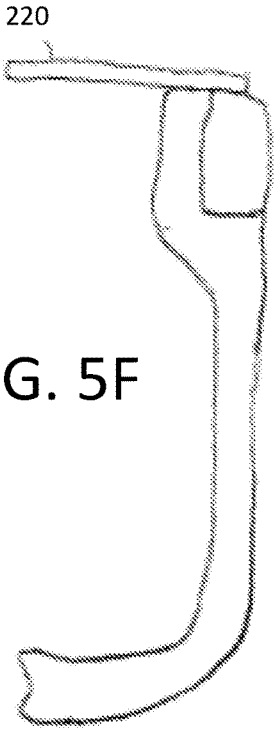

FIG. 5B illustrates a bolt catch control device having a feature 260 which is rotatable about pivot point 262. Feature 216 may be spring-loaded (for example, by a torsion spring) so as to be biased in the illustrated position. Connecting upper receiver 276 two lower receiver 277 causes feature 262 deflect by rotating about pivot point 262 as indicated by the illustrated arrow. When deflected, the torsion spring exerts a force biasing the bolt catch control device.

FIGS. 5C, 5D, 5E, and 5F illustrate bolt catch control devices having springs 220, which may be either leaf springs or wire springs. The springs 220 of FIGS. 5C, 5D, 5E, and 5F may be fixed to the remainder of the bolt catch control device for example with a screw attaching the front to the back. For example a portion of the springs may be compressed between the front and the back by the screw.

The springs of FIGS. 5C, 5D, 5E, and 5F are relaxed in the illustrated positions. Connecting upper receiver 276 two lower receiver 277 causes the springs of FIGS. 5C, 5D, 5E, and 5F deflect. When deflected, the springs exert a force biasing the bolt catch control device.

Figure 6:
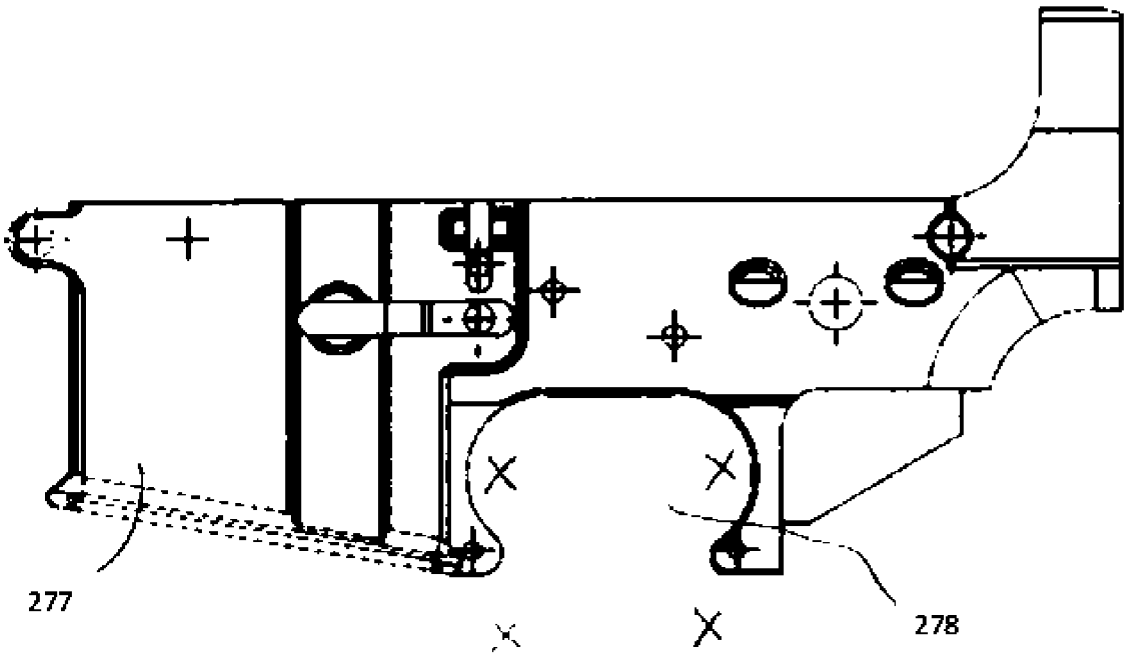

FIG. 6 illustrates a lower receiver 277 and exemplary positions the tip 250 of bolt catch control device 200 may extend to. As shown, the tip 250 of bolt catch control device 200 may extend into or beneath trigger guard 278, for example, at positions indicated by an X. In alternative embodiments, tip 250 may be at other positions. In some embodiments, bolt catch control device 200 includes multiple arms each extending to one of multiple tips, where the tips are at multiple positions, for example as indicated by the X's in FIG. 6. In some embodiments the tip 250 is large enough to, for example, be located at more than one of the positions indicated by the X's in FIG. 6. In some embodiments, bolt catch control device 200 includes multiple tips at multiple positions, for example as indicated by the X's in FIG. 6.

FIGS. 7A-7D illustrate an embodiment having a feature 255 which prevents the weapon from being fired while the tip 250 the bolt catch control device is depressed.

Figure 7A:
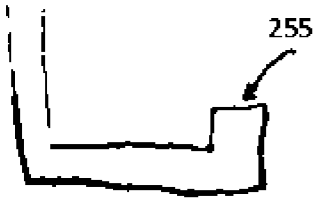
FIGS. 7A-7D illustrate an embodiment having a feature 255 which prevents the weapon from being fired while the tip 250 the bolt catch control device is depressed.
Figure 7B:
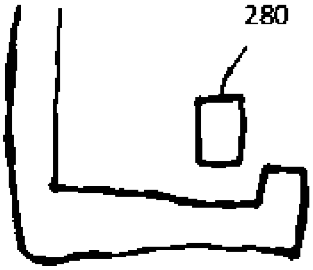

FIG. 7B illustrates the bolt catch control device while not being depressed and while the bolt of the weapon is back and is prevented from chambering a next round by the bolt catch control device. In this position, the trigger 280 is blocked by the bolt carrier group of the weapon.

Figure 7C:
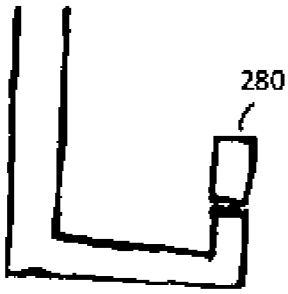

FIG. 7C illustrates the bolt catch control device while being depressed. In this position, the bolt is forward, and a next round has been chambered. In this position, feature 255 blocks trigger 280, and, as a result, the weapon cannot be fired.

Figure 7D:
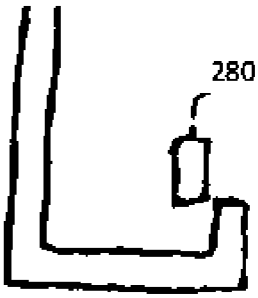
Figure 8A:
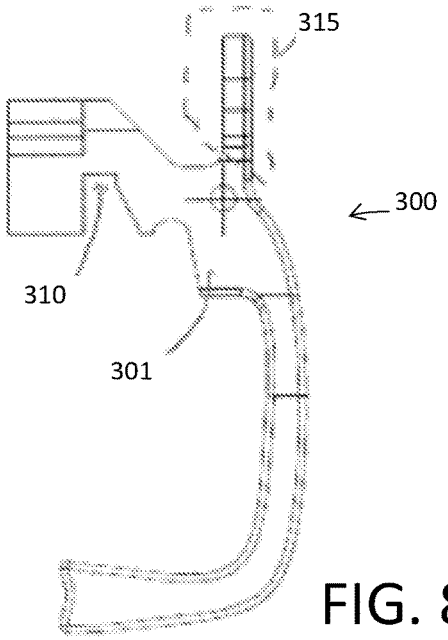
FIGS. 8A-8D illustrate different views of an embodiment of a bolt catch 300 having an integrated bolt catch control device.
Figure 8B:
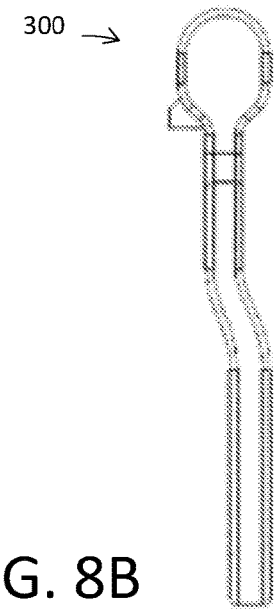
Figure 8C:
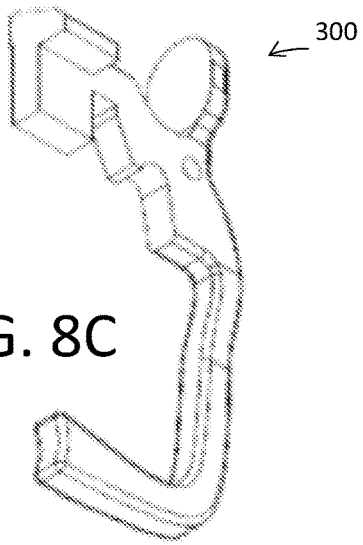
Figure 8D:
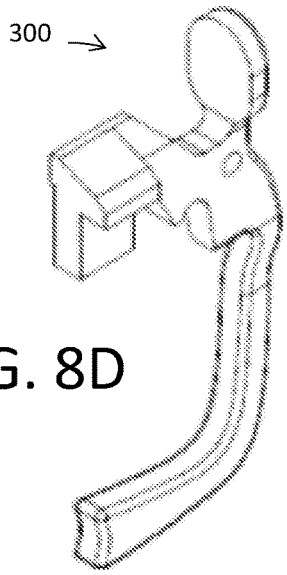

FIG. 7D illustrates the bolt catch control device while not being depressed and while the bolt of the weapon is forward, having chambered a next round. As shown, while the bolt catch control device is not depressed, the trigger is unobstructed, and, as a result, the weapon may be fired.

FIGS. 8A-8D illustrate different views of an embodiment of a bolt catch 300 having an integrated bolt catch control device. Accordingly, to manufacture a weapon having the bolt catch control functionality described herein, bolt catch 300 may be used instead of a conventional bolt catch.

Instead of the conventional compression spring applying a force to a portion of a conventional bolt catch corresponding with position 301, in this embodiment, a compression spring engages feature 310, and applies a force biasing the bolt catch 300.

As shown, this embodiment does not have the conventional extension which engages the follower of an empty magazine. In some embodiments, bolt catch 300 includes an extension configured to engage the follower of a standard ammunition storage magazine such that the follower engages the extension when the magazine is held in the magazine well of the weapon and the magazine is empty of ammunition, and therefore causes the bolt catch 300 to hold the bolt carrier group of the weapon in the back position. The extension may, for example, be similar or identical in form as extensions in standard or conventional bolt catches which function similarly.

In some embodiments, paddle 315 is omitted.

FIGS. 9A-9H illustrate various embodiments of bolt catches 300 having various spring engagement features 310.

In the embodiments illustrated in FIGS. 9A and 9D-9H, the spring engagement features 310 may capture the spring by pressing on an outer diameter surface of the spring, such that the springs are substantially fixed to the bolt catch 300. In the embodiments illustrated in FIGS. 9B and 9C, the spring engagement features 310 include protrusions which extend from the remainder of the bolt catch 300 as shown, and may be configured to capture the spring by pressing on an inner diameter surface of the spring, such that the springs are substantially fixed to the bolt catch 300. In some embodiments the spring engagement features 310 receive a spring, for example, at one or more surfaces, but do not capture the spring. Accordingly, in such embodiments, the springs are not substantially fixed to the bolt catch 300.

Figure 9A:
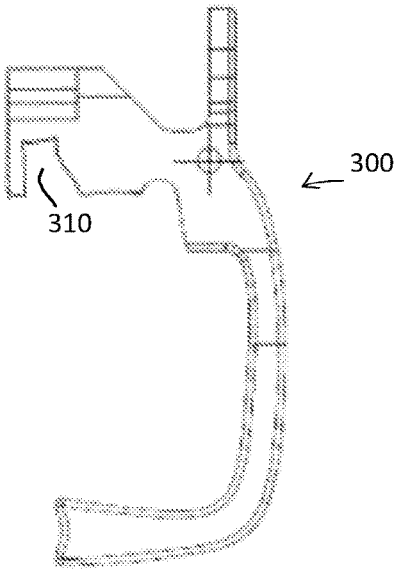
FIGS. 9A-9H illustrate various embodiments of spring engagement features 310.
Figure 9B:
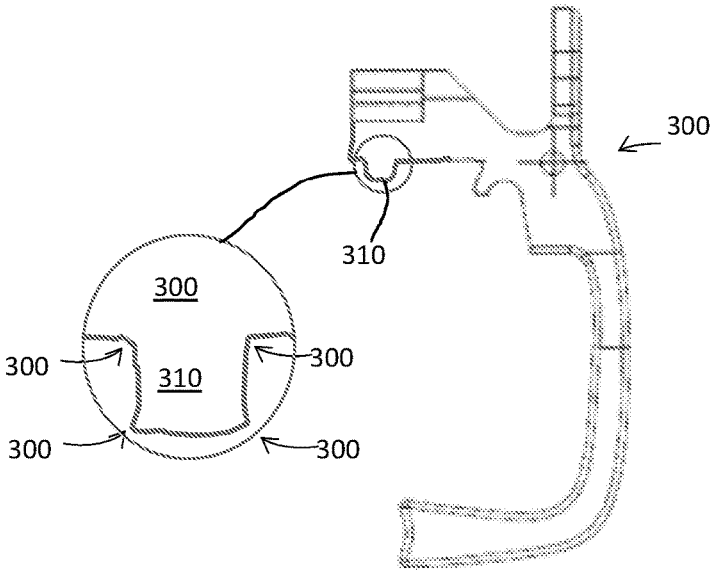
Figure 9C:
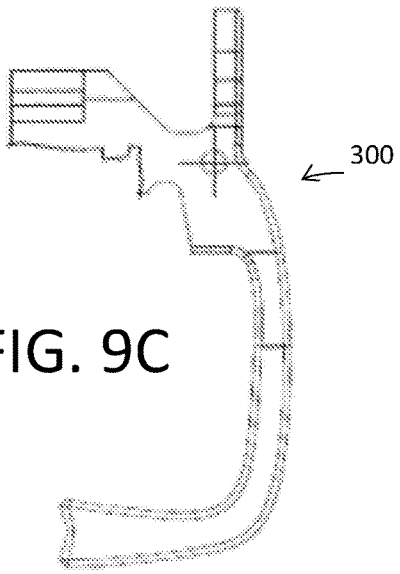
Figure 9D:
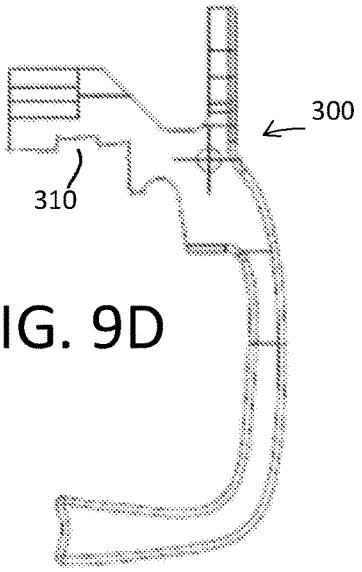
Figure 9E:
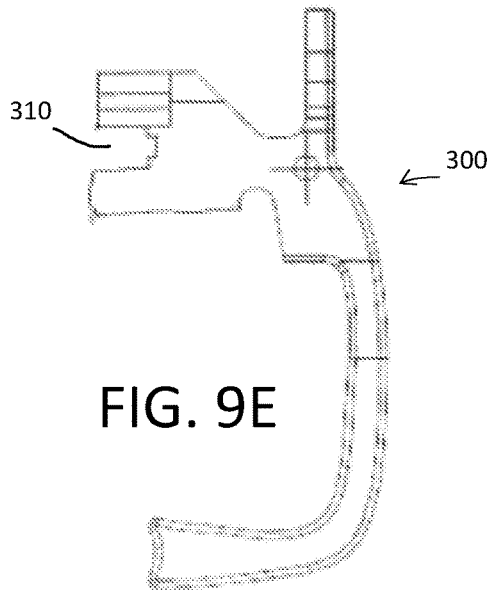

The magnified portion of FIG. 9B illustrates a magnified view of the spring engagement feature 310 of FIG. 9B. As illustrated, the spring engagement feature 310 of FIG. 9B includes first fillets 312 between the spring engagement feature 310 and the remaining portion of bolt catch control device 300. In some embodiments, spring engagement feature 310 additionally or alternatively includes fillets 314.

In some embodiments, from the planar view indicated by the illustrated arrow of FIG. 9B, the spring engagement feature 310 is circular or substantially circular. In some embodiments, from the planar view indicated by the illustrated arrow of FIG. 9B, the spring engagement feature is rectangular or is substantially rectangular, or is square or is substantially square.

In some embodiments, the spring engagement feature 310 has a first cross-sectional circumference in a first plane parallel with the planar view indicated by the illustrated arrow of FIG. 9B, and a second cross-sectional circumference in a second plane parallel with the planar view indicated by the illustrated arrow of FIG. 9B. The first cross-sectional circumference may be greater than the second cross-sectional circumference, where the first plane is at a distal portion of the spring engagement feature 310 relative to the second plane along the protrusion of the spring engagement feature 310 extending from the remainder of the bolt catch 300. Such an arrangement of the spring engagement feature 310 allows the spring engagement feature 310 to securely capture a spring, such that the spring may be fixed to the spring engagement feature 310. For example, in some embodiments, the spring may be fixed to the spring engagement feature 310 such that the spring may not be removed from the spring may be fixed to the spring engagement feature 310 without exerting a force on the spring and the spring engagement feature 310.

Figure 9F:
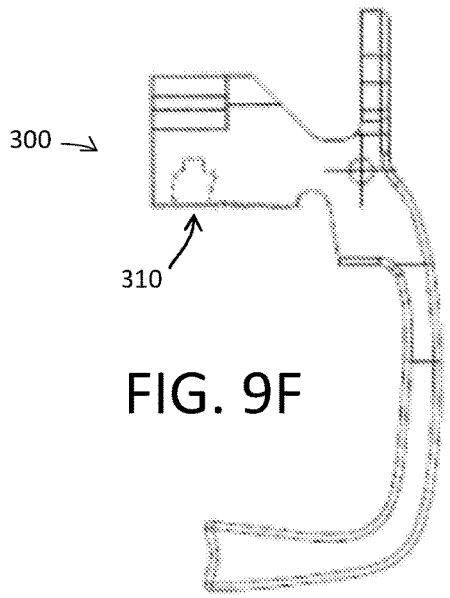
Figure 9G:
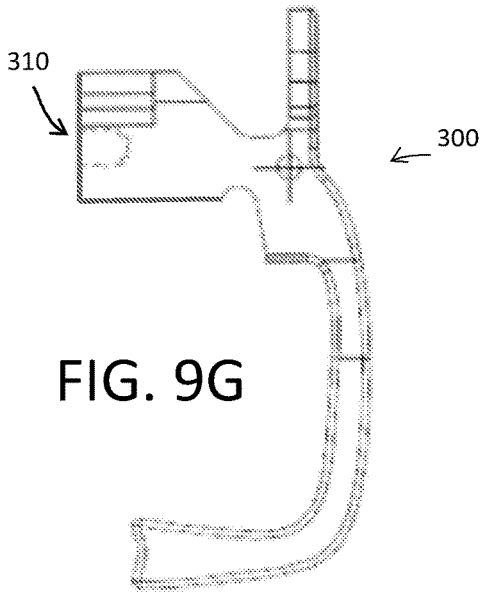
Figure 9H:
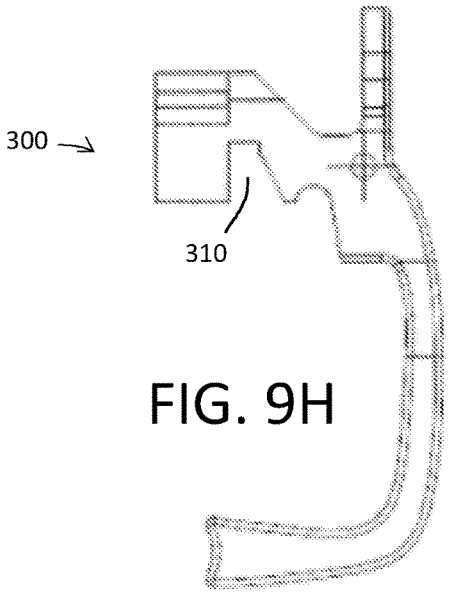

In some embodiments, such as those illustrated in FIGS. 9F and 9G, spring engagement feature 310 is formed by a cavity in the bolt catch 300. For example, the cavity may be a hole bored in bolt catch 300. As illustrated, the cavity may have multiple portions, each having different cross-sectional dimensions. The smaller portion may capture the spring and the larger portion may allow for the bolt catch to be moved without engaging the spring.

In some embodiments, the spring which engages spring engagement feature 310 is not a standard coiled compression spring. For example, the spring may be a wire bent in another configuration, where, similar to a compression spring, a first portion of the spring engages spring engagement feature 310 and a second portion of the spring engages the lower receiver of the weapon, and is configured, absent a counteracting force, to exert a force causing the bolt catch to be positioned to capture the bolt carrier group, for example, as discussed elsewhere herein.

FIG. 10 illustrates an embodiment configured to prevent the bolt catch from releasing the captive bolt as a result of the last round of a magazine being fired.

FIG. 11 illustrates various views of an alternative embodiment 400 configured to prevent the bolt catch from releasing the captive bolt as a result of the last round of a magazine being fired. In the illustrated embodiment, bolt catch 400 includes element 410 which is rotatable about pivot 415 under the influence of spring 420. In response to the magazine being empty, follower extension 285 presses against element 410 and causes element 410 to rotate about pivot 415 against the force of spring 420. As a result of the rotation, a portion 417 of element 410 rotate so as to be above a portion of receiver 277. With the portion 417 above the portion of receiver 277, bolt catch 400 is prevented from releasing the captive bolt carrier group.

Figure 12A:
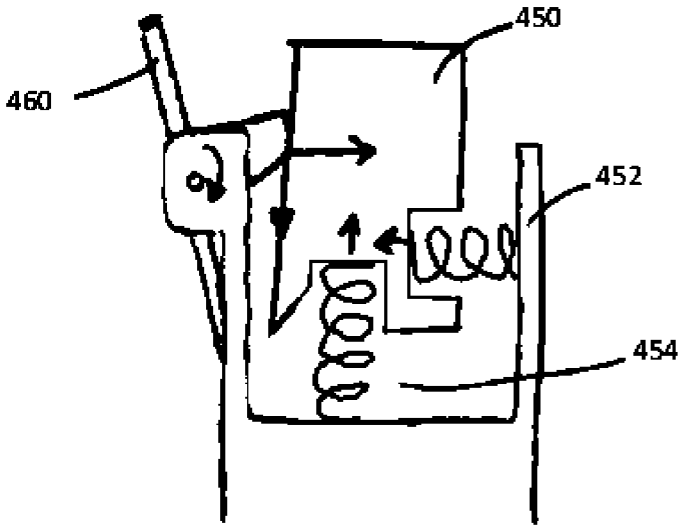
FIGS. 12A and 12B illustrate an embodiment which allows the bolt catch 450 to release the bolt only one time for each actuation of the bolt catch control device 460.
Figure 12B:
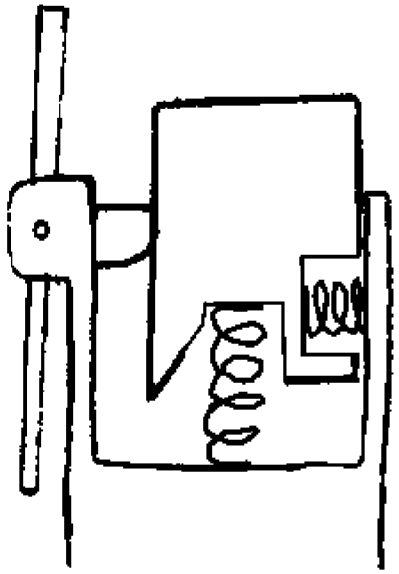

FIGS. 12A and 12B illustrate an embodiment which allows the bolt catch 450 to release the bolt only one time for each actuation of the bolt catch control device 460. As shown in FIG. 12A, rotation of the bolt catch control device 460 causes bolt catch 450 to compress springs 452 and 454, resulting in the bolt being released. Once the bolt catch control device 460 rotates to the position shown in FIG. 12B, spring 454 biases bolt catch 450 upward as shown in the illustration. Bolt catch 450 may then again capture the bolt after the weapon has been fired. To release the bolt, bolt catch control device 460 must be moved to a position such as that illustrated in FIG. 12A in order to again cause bolt catch 450 to compress springs 452 and 454 in response to a second distinct actuation action.

Figure 13A:
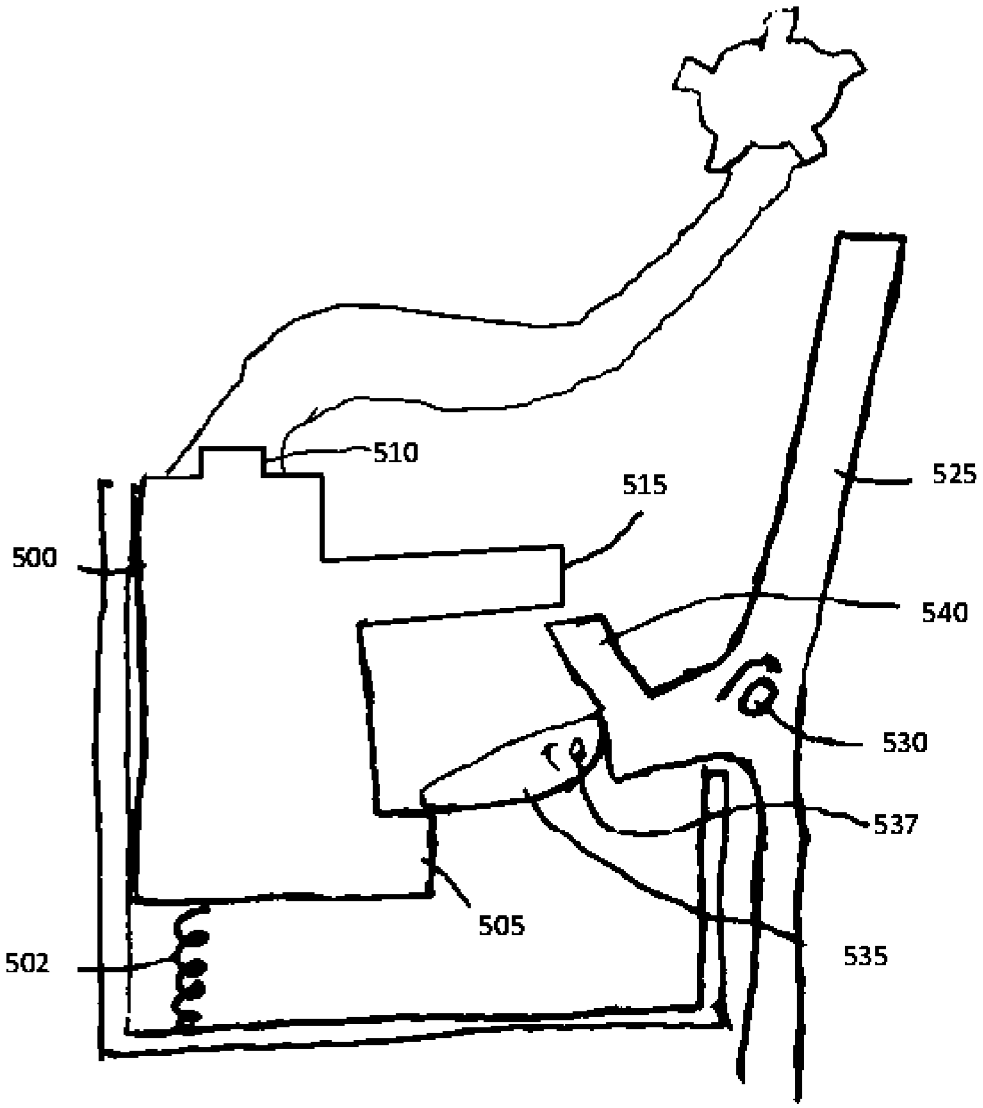
FIGS. 13A and 13B illustrate an embodiment which allows the bolt catch 500 to release the bolt only one time for each actuation of the bolt catch control device 525.
Figure 13B:
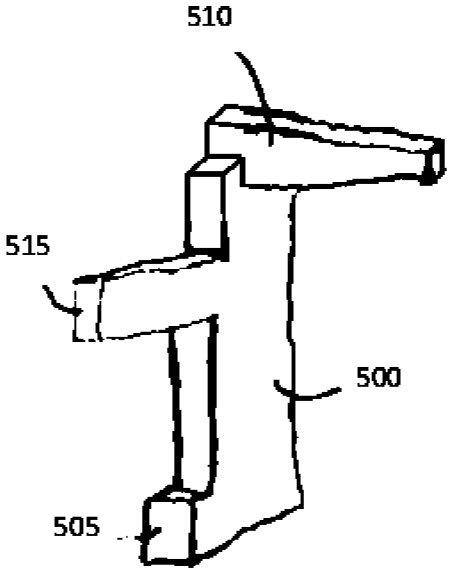

FIGS. 13A and 13B illustrate an embodiment which allows the bolt catch 500 to release the bolt only one time for each actuation of the bolt catch control device 525.

Bolt catch control device 525 rotates about pivot 530 as biased in a direction indicated by the illustrated arrow at pivot 530. Bolt catch control device 525 includes spring-loaded arm 535 rotatable about pivot 537 and spring-loaded so as to be biased in a direction indicated by the illustrated arrow at pivot 537. Bolt catch control device 525 also includes arm 540.

Bolt catch 500 includes arms 505, 510, and 515.

When rotated against the bias indicated by the illustrated arrow at pivot 530, spring-loaded arm 535 presses against arm 505 causing bold catch 500 to compress spring 502 and to release the captive bolt. In response to being released, the bolt carrier group presses against arm 510 and causes bolt catch 500 to further compress spring 502.

Bolt catch control 525 further rotates in response to arm 505 moving out of the path of spring-loaded arm 535. For example, a portion of bolt catch control 525 may flex in response to the pressure needed to cause bolt catch control 525 to rotate. Energy stored in the flexing is released by causing spring-loaded arm 535 to further rotate. Additionally or alternatively, the bolt carrier group pressing against arm 510 causes arm 515 to press against arm 540. As a result, bolt catch 500 is free to respond to spring 502 so as to capture the bolt after the weapon is fired, and bolt catch control device 525 cannot be used to hold the bolt catch 500 in a position which does not obstruct the movement of the bolt.

To enable bolt catch control device 525, bolt catch control device 525 is released and rotates about pivot 530 in response to the spring bias indicated at pivot 530. As a consequence, spring-loaded arm 535 slides along arm 505, rotates against the spring bias of pivot 537, and returns to a position above arm 505 as illustrated in FIG. 13A. To release the captured bolt, bolt catch control device 525 is rotated against the bias indicated at pivot 530, as discussed above.

Figure 14:
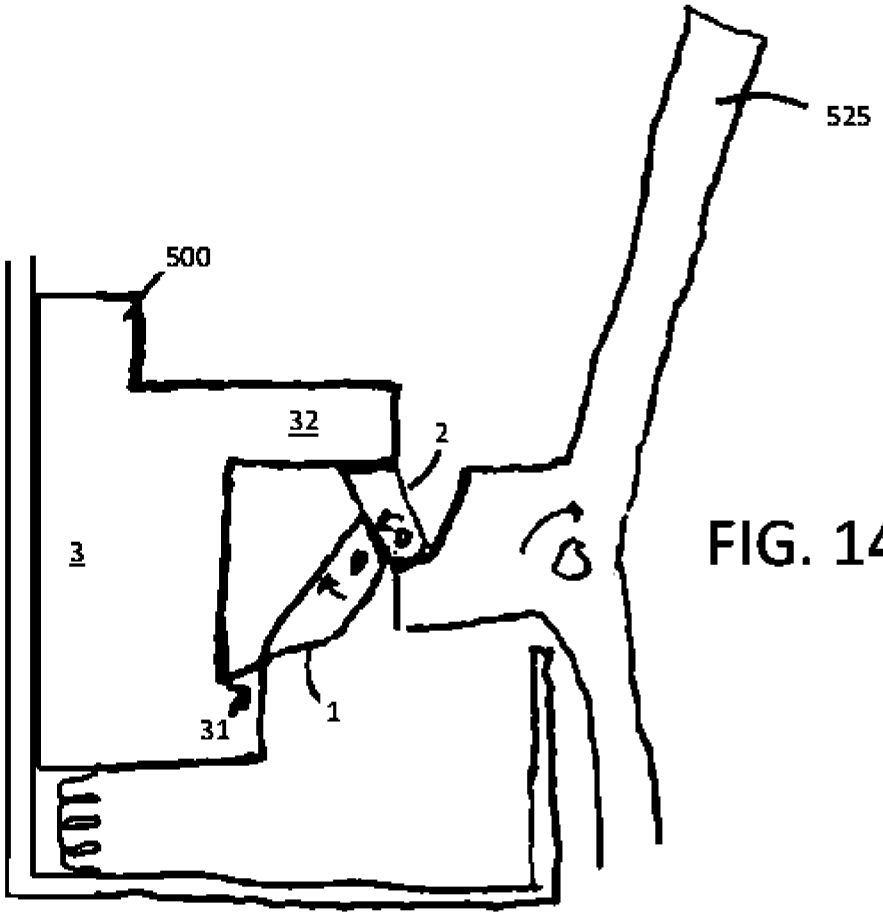
FIG. 14 illustrates an embodiment which allows the bolt catch 500 to release the bolt only one time for each actuation of the bolt catch control device 525 and has operational and structural features similar to those of the embodiment of FIGS. 13A and 13B, some of which are summarized in the text of FIG. 14.

FIG. 14 illustrates an embodiment which allows the bolt catch 500 to release the bolt only one time for each actuation of the bolt catch control device 525 and has operational and structural features similar to those of the embodiment of FIGS. 13A and 13B, some of you which are summarized in the text of FIG. 14.

Figure 15:
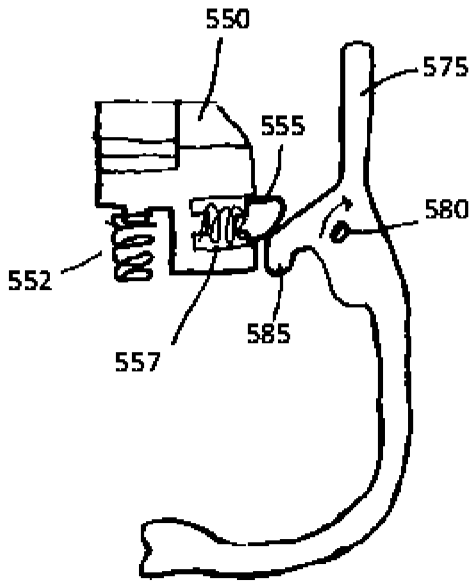
FIG. 15 illustrates an embodiment which allows the bolt catch 550 to release the bolt only one time for each actuation of the bolt catch control device 575 and has operational and structural features similar to those of the embodiments of FIGS. 13A and 13B, and 14.

FIG. 15 illustrates an embodiment which allows the bolt catch 550 to release the bolt only one time for each actuation of the bolt catch control device 575 and has operational and structural features similar to those of the embodiments of FIGS. 13A and 13B, and 14.

To cause bolt catch 550 to release the bolt, bolt catch control device 575 is rotated about pivot 580 and a direction against the bias indicated by the illustrated arrow at pivot 580. In response to the rotation, protrusion 585 presses against latch 555. Latch 555 causes bolt catch 552 compress spring 552 and releases the bolt.

In response to the bolt being released, bolt catch control device 575 further rotates, for example, because of a mechanism similar or identical to those discussed above. As a result of the further rotation of bolt catch control device 575, bolt catch 550 is free to respond to spring 552 so as to capture the bolt after the weapon is fired, and bolt catch control device 575 cannot be used to hold the bolt catch 550 in a position which does not obstruct the movement of the bolt.

To enable bolt catch control device 575, bolt catch control device 575 is released and rotates about pivot 580 in response to the spring bias indicated at pivot 580. As a consequence, spring-protrusion 585 slides along latch 555, causes latch 555 to compress spring 557, and returns to a position above latch 555. To release the captured bolt, bolt catch control device 575 is rotated against the bias indicated at pivot 580, as discussed above.

Springs 552 and 557 to be captured by spring engagement features similar to those discussed above.

Figure 16:
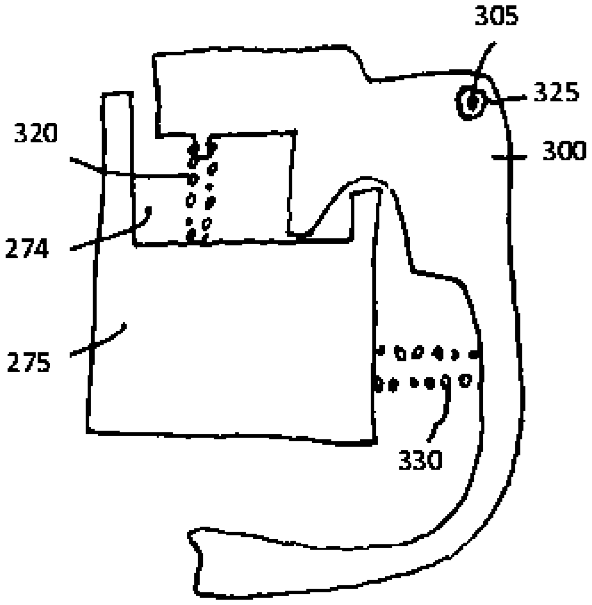
FIG. 16 is a cross-sectional view of a bolt catch 300 attached to a weapon 275, for example at its lower receiver by pin 305 which extends through a hole 325 and which engages the lower receiver.

FIG. 16 is a cross-sectional view of a bolt catch 300 rotatably attached to a weapon 275, for example at its lower receiver by pin 305 which extends through a hole 325 and which is substantially fixed to the lower receiver. This connection configuration is similar or identical to the attachment configuration of standard bolt catches with standard lower receivers.

As shown in FIG. 16 bolt catch 300 is connected to spring 320, which engages the lower receiver of the weapon 275, and is configured, absent a counteracting force, to exert a force causing the bolt catch 300 to be positioned to capture the bolt carrier group, for example, as discussed elsewhere herein. As shown, spring 320 extends from bolt catch 300 and engages weapon 275 within a cavity 274 of weapon 275 configured to receive bolt catch 300. Cavity 274 of weapon 275 may be configured to receive conventional bolt catches. Accordingly, spring 320 occupies a space within cavity 274, and the space may conventionally be occupied by a standard or conventional bolt catch.

In the embodiment illustrated in FIG. 16, a second spring 330 engages bolt catch 300 and weapon 275. Spring 330 is configured to exert a force causing the bolt catch 300 to counteract the force exerted by spring 320 such that bolt catch 300 is positioned to not capture the bolt carrier group, unless another force is exerted on bolt catch 300. The other force may, for example, be a follower of an empty ammunition magazine. With second spring 330, weapon 275 operates as a semi-automatic weapon.

In some embodiments, second spring 330 may be positioned to engage bolt catch 300 and weapon 275 without tools. In some embodiments, second spring 330 may be moved so as to not engage at least one of bolt catch 300 and weapon 275 without tools.

In some embodiments, bolt catch 300 may include a spring engagement feature, such as spring engagement feature 310 discussed elsewhere herein.

In some embodiments, the second spring 330 is a coiled compression spring. In some embodiments, the second spring 330 is not a standard coiled compression spring. For example, the second spring 330 may be a wire bent in another configuration, where, similar to a compression spring, one or more first portions of the second spring 330 engages bolt catch 300, and one or more second portions of the second spring 330 engages the weapon, and is configured to exert a force causing the bolt catch to be positioned to not capture the bolt carrier group, unless another force is exerted on bolt catch 300.

In some embodiments, the features discussed herein with reference to bolt catches may be applied to a slide release of a pistol. For example, a slide release may be biased with a spring so that the slide release catches the slide after every fired shot, regardless of the number of rounds in the magazine. In some embodiments, the features discussed herein with reference to bolt catch controllers may be applied to devices configured to control a slide release of a pistol.

In some embodiments, the features of the embodiments discussed herein are combined in ways not specifically discussed.

Though the present invention is disclosed by way of specific embodiments as described above, those embodiments are not intended to limit the present invention. Based on the methods and the technical aspects disclosed above, variations and changes may be made to the presented embodiments by those skilled in the art without departing from the spirit and the scope of the present invention.

What is claimed is:

1. A bolt catch device comprising:

a movable surface configured to be positioned within a weapon so as to conditionally engage a bolt so as to prevent the bolt from rechambering a next round from a magazine;

a tip configured to, in response to a received force, cause the movable surface to move so as to release the bolt; and a spring engagement feature configured to be positioned within the weapon so as to receive a spring within the weapon, wherein the spring within the weapon is configured to bias the movable surface toward a position which prevents the bolt from rechambering a next round, wherein the tip is connected to the movable surface by an arm, and wherein the arm is configured such that, when the bolt catch device is attached to the weapon, the arm at least partially extends through a trigger guard of the weapon.

2. The bolt catch device of claim 1, wherein the bolt catch device, when rotatably attached to the weapon by a pin, does not include a paddle positioned such that the pin is between the paddle and the trigger of the weapon, and configured to, in response to a received force, cause the surface to move so as to release the bolt.

3. The bolt catch device of claim 1, wherein the spring engagement feature is configured to capture the spring, such that the spring is substantially fixed to the bolt catch device.

4. The bolt catch device of claim 1, wherein the spring engagement feature is configured to engage the spring such that the spring is at least partially within a cavity of the weapon configured to receive the bolt catch when the bolt catch is attached to the weapon.

5. The bolt catch device of claim 1, further comprising an extension configured to engage a follower of an ammunition magazine when the bolt catch and the magazine are attached to the weapon and when the magazine is empty of ammunition, whereby the follower causes the extension to cause the movable surface to engage the bolt.

6. The bolt catch device of claim 1, further comprising a spring surface configured to engage a second spring, wherein, when the bolt catch is attached to the weapon, the second spring is configured to engage the spring surface and the weapon such that the second spring causes the movable surface to be positioned so as to not engage the bolt.

7. A weapon, comprising:

an upper receiver;

a bolt carrier group connected to the upper receiver;

a lower receiver, comprising a cavity configured to receive a bolt catch;

a spring at least partially within the cavity; and a bolt catch device attached to the lower receiver and positioned so as to be partially within the cavity, the bolt catch device comprising:

a movable surface configured to conditionally engage the bolt carrier group so as to prevent the bolt carrier group from rechambering a next round from the magazine, a tip configured to, in response to a received force, cause the movable surface to move so as to allow the bolt carrier group to rechamber the next round, and a spring engagement feature configured to engage the spring, wherein the spring is configured to bias the movable surface toward a position which prevents the bolt carrier group from rechambering a next round, wherein the tip is connected to the movable surface by an arm at least partially extending through a trigger guard of the weapon.

8. The weapon of claim 7, wherein the bolt catch device is connected to the lower receiver by a pin, and wherein the bolt catch device does not include a paddle positioned such that the pin is between the paddle and the trigger of the weapon, and configured to, in response to a received force, cause the surface to move so as to release the bolt.

9. The weapon of claim 7, wherein the spring engagement feature is configured to capture the spring, such that the spring is substantially fixed to the bolt catch device.

10. The weapon of claim 7, wherein the bolt catch further comprises an extension configured to engage a follower of an ammunition magazine attached to the lower receiver when the magazine is empty of ammunition, whereby the follower causes the extension to cause the movable surface to engage the bolt carrier group.

11. The weapon of claim 7, further comprising a second spring configured to engage a spring surface of the bolt catch and the lower receiver such that the second spring causes the movable surface of the bolt catch to be positioned so as to not engage the bolt carrier group.

12. A method of assembling a weapon, the method comprising:

providing an upper receiver having a bolt carrier group, comprising a bolt;

providing a lower receiver comprising a cavity configured to receive a bolt catch device;

placing a spring at least partially within the cavity; and attaching a bolt catch device to the lower receiver such that the bolt catch device is partially within the cavity and is configured to engage the bolt carrier group, wherein the bolt catch device comprises:

a movable surface configured to be positioned within the cavity, so as to conditionally engage the bolt so as to prevent the bolt from rechambering a next round from a magazine;

a tip configured to in response to a received force, cause the movable surface to move so as to release the bolt; and a spring engagement feature configured to be positioned within the cavity so as to receive the spring within the cavity, wherein the spring within the cavity is configured to bias the movable surface toward a position which prevents the bolt from rechambering a next round, wherein the tip is connected to the moveable surface by an arm, and wherein the arm is configured such that, when the bolt catch device is attached to the weapon the arm at least partially extends through a trigger guard of the weapon.

13. The method of claim 12, further comprising attaching the bolt catch device to the lower receiver with a pin, wherein the bolt catch device does not include a paddle positioned such that the pin is between the paddle and the trigger of the weapon, and configured to, in response to a received force, cause the surface to move so as to release the bolt.

14. The method of claim 12, wherein the bolt catch further comprises an extension configured to engage a follower of an ammunition magazine attached to the lower receiver when the magazine is empty of ammunition, whereby the follower causes the extension to cause the movable surface to engage the bolt carrier group.

15. The method of claim 12, further comprising positioning a second spring on the weapon, wherein the second spring is configured to engage a spring surface of the bolt catch and the lower receiver such that the second spring causes the movable surface of the bolt catch to be positioned so as to not engage the bolt.

* * * * *